US010122128B1

(12) United States Patent
Lu

(10) Patent No.: US 10,122,128 B1
(45) Date of Patent: Nov. 6, 2018

(54) TABLE CABINET HAVING REVERSIBLE POWER SOCKET

(71) Applicant: Dong Guan Song Wei Electric Technology Co., Ltd., Dongguan (CN)

(72) Inventor: Weilin Lu, Dongguan (CN)

(73) Assignee: DONG GUAN SONG WEI ELECTRIC TECHNOLOGY CO., LTD., Dongguan, Guangdong (CN)

( * ) Notice: Subject to any disclaimer, the term of this patent is extended or adjusted under 35 U.S.C. 154(b) by 0 days.

(21) Appl. No.: 15/795,282

(22) Filed: Oct. 27, 2017

(30) Foreign Application Priority Data

Apr. 17, 2017 (CN) ..... 2017 1 0249077

(51) Int. Cl.

| | |
|---|---|
| ***H01R 13/73*** | (2006.01) |
| ***H01R 27/02*** | (2006.01) |
| ***A47B 21/06*** | (2006.01) |
| ***A47B 83/04*** | (2006.01) |
| *H01R 24/64* | (2011.01) |
| *H01R 107/00* | (2006.01) |
| *H01R 103/00* | (2006.01) |
| *H01R 24/20* | (2011.01) |

(52) U.S. Cl.
CPC ..... *H01R 13/73* (2013.01); *A47B 21/06* (2013.01); *A47B 83/045* (2013.01); *H01R 27/02* (2013.01); *A47B 2021/068* (2013.01); *H01R 24/20* (2013.01); *H01R 24/64* (2013.01); *H01R 2103/00* (2013.01); *H01R 2107/00* (2013.01)

(58) Field of Classification Search
CPC ..... H01R 13/73
See application file for complete search history.

(56) References Cited

U.S. PATENT DOCUMENTS

2011/0109211 A1* 5/2011 Kirkeby ..... A47B 81/00 312/223.6
2017/0077691 A1* 3/2017 Zheng ..... H02G 3/185

* cited by examiner

*Primary Examiner* — Ross N Gushi
(74) *Attorney, Agent, or Firm* — Leong C. Lei

(57) ABSTRACT

A table cabinet having a reversible power socket includes a table cabinet main body. The table cabinet main body has a mounting opening. The reversible power socket is mounted to the mounting opening. The power socket includes a socket body, a power supply interface, a pop-up device, and a pop-up button. The pop-up device has a rotating shaft. The operation is convenient and practical. The power socket can be protected. In particular, it has a simple structure, and can be controlled easily, and has good reliability and low cost.

9 Claims, 8 Drawing Sheets

TABLE CABINET HAVING REVERSIBLE POWER SOCKET

BACKGROUND OF THE INVENTION

1. Field of the Invention

The present invention relates to a table cabinet, and more particularly to a table cabinet having a reversible power socket.

2. Description of the Prior Art

These days, in most families, offices and other occasions, a power socket is disposed at the side of a table cabinet or on a table top. This takes up space and is chaotic and affects the appearance and is not safe. Later, the power socket is designed to be hidden in the table cabinet. When in use, the power socket can be popped out. When not in use, the power socket can be hidden in the table cabinet. But, the structure is more complex and has poor controllability and high cost. It is not widely used. Accordingly, the inventor of the present invention has devoted himself based on his many years of practical experiences to solve these problems.

SUMMARY OF THE INVENTION

In view of the shortcomings of the prior art, the primary object of the present invention is to provide a table cabinet having a reversible power socket. The operation is convenient and practical. The power socket can be protected. In particular, it has a simple structure, and can be controlled easily, and has good reliability and low cost, and is suitable for popularization and application.

In order to achieve the aforesaid object, the table cabinet having a reversible power socket of the present invention comprises a table cabinet main body. The table cabinet main body has a mounting opening. The reversible power socket is mounted to the mounting opening. The power socket includes a socket body, a power supply interface on the socket body, a pop-up device for providing an outwardly pivoting force to the socket body, and a pop-up button for limiting and controlling the socket body.

The pop-up device has a rotating shaft. The rotating shaft is connected to the socket body for controlling the socket body to be rotatably disposed relative to the table cabinet main body. The pop-up button has a press portion and a first engaging point. The pop-up button is connected with a return spring for returning the pop-up button. One end of the return spring is connected to the pop-up button. Another end of the return spring is fixed to the table cabinet main body. The socket body is provided with a second engaging point mated with the first engaging point.

The present invention has obvious advantages and beneficial effects compared with the prior art. In particular, it is known from the above technical solution that the power socket is integrated with the table cabinet. The power socket has a pop-up and hidden design relative to the table cabinet. When the power socket is required, the pop-up device is actuated by pressing the pop-up button to drive the socket body to be popped out. The socket body can be directly pressed inwardly when not in use. The operation is convenient and practical. The power socket is protected from dust and water. The present invention not only enhances the safety of the use for the power socket but also improves the cleanliness of the table cabinet surface. In particular, the product of the present invention has a simple structure, and can be controlled easily, and has good reliability and low cost, and is suitable for popularization and application.

DETAILED DESCRIPTION OF THE PREFERRED EMBODIMENTS

Embodiments of the present invention will now be described, by way of example only, with reference to the accompanying drawings.

Figure 1:
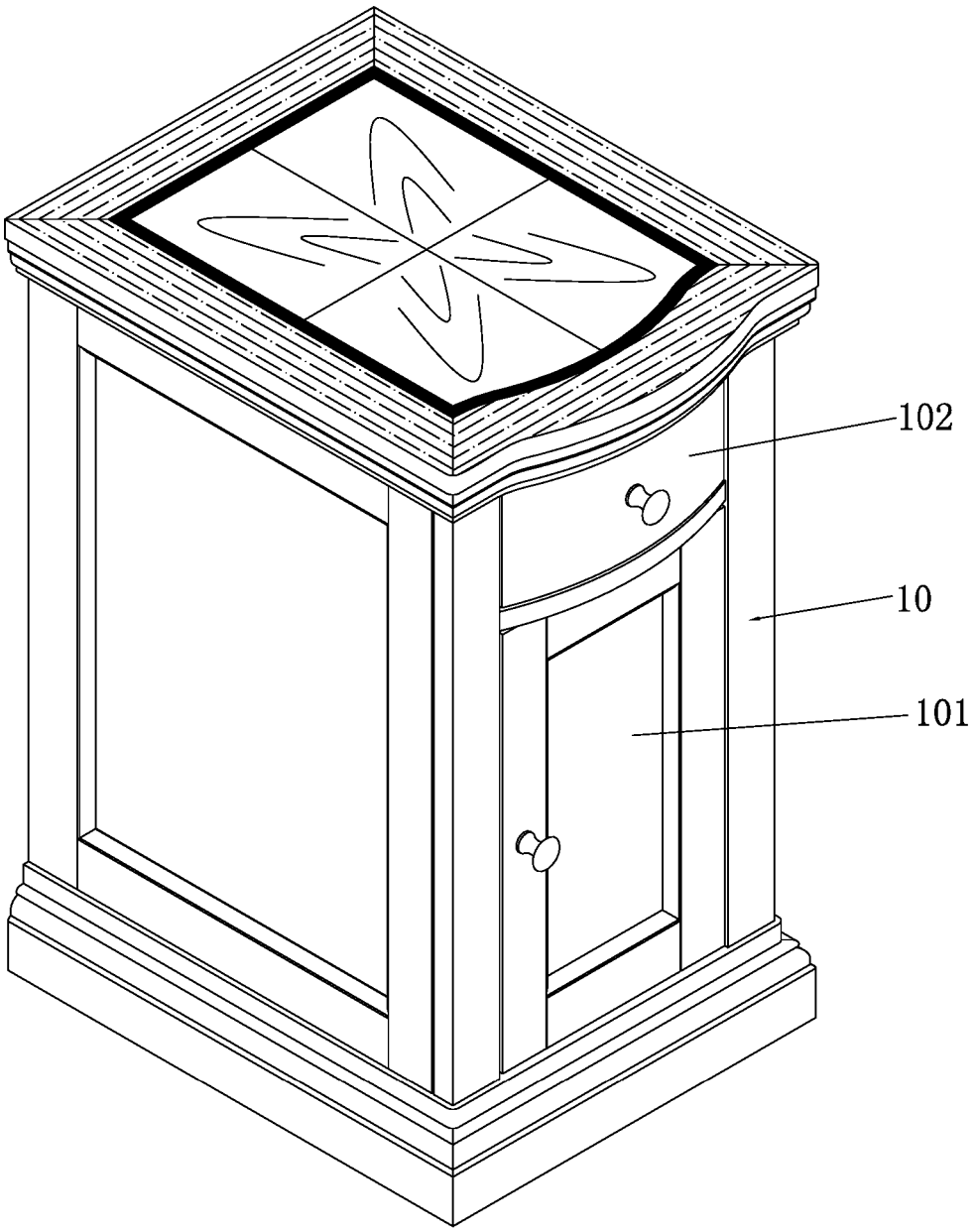
FIG. 1 is a perspective view in accordance with an embodiment of the present invention.
Figure 2:
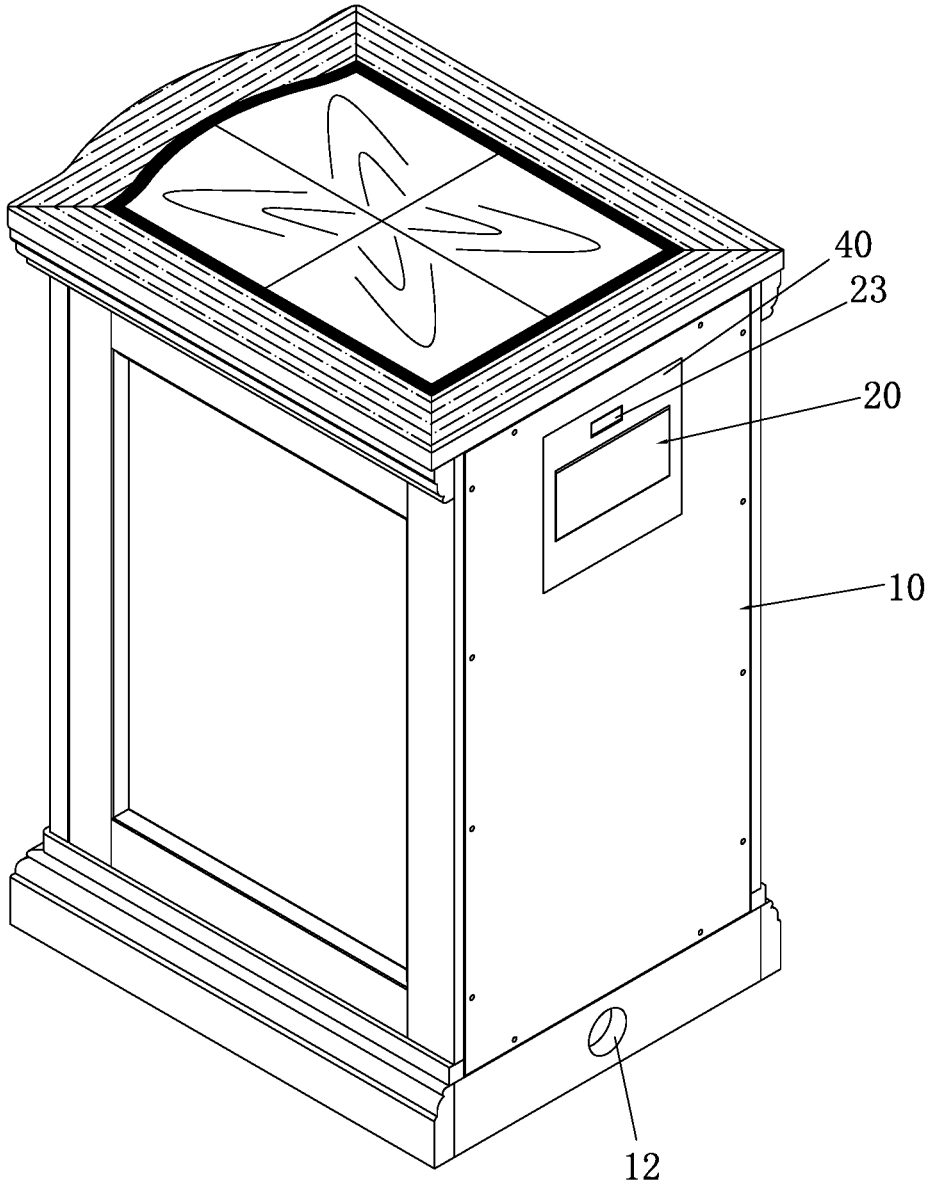
FIG. 2 is another perspective view in accordance with the embodiment of the present invention.
Figure 3:
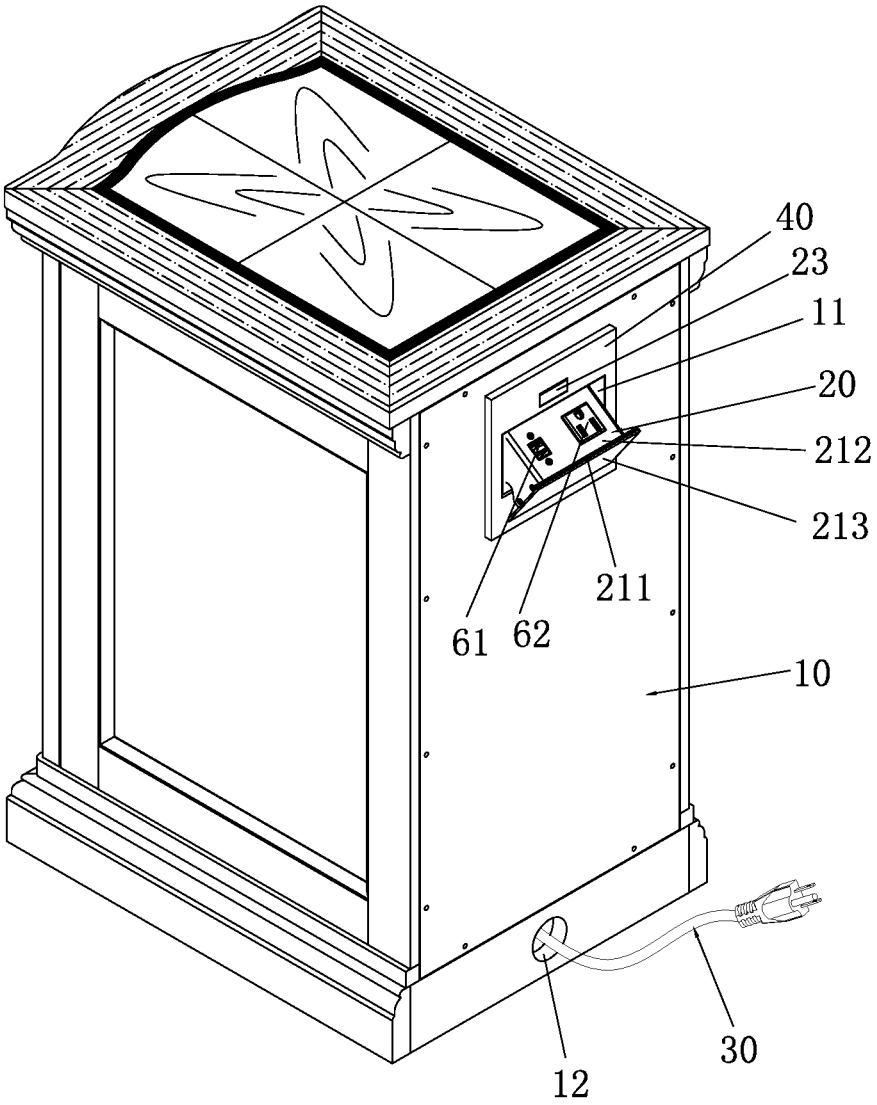
FIG. 3 is a schematic view in accordance with the embodiment of the present invention, showing the socket body in a pop-up state.
Figure 4:
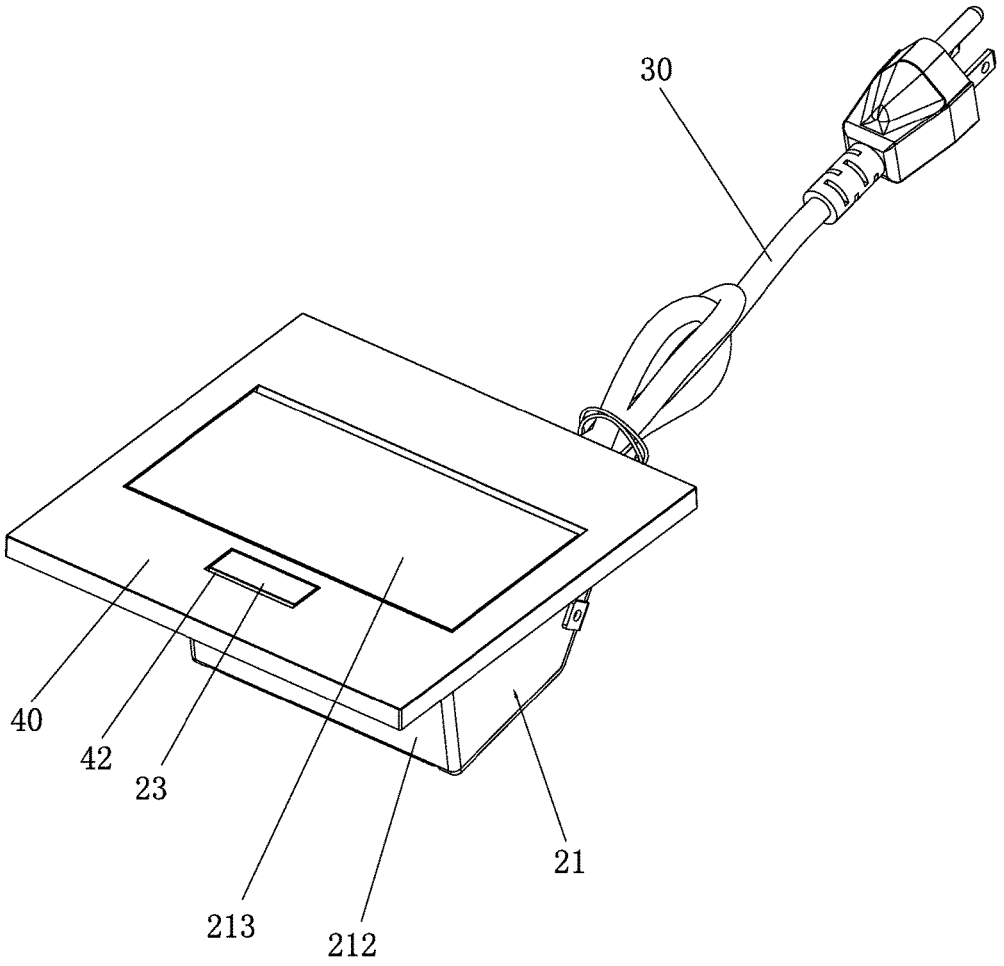
FIG. 4 is a schematic view in accordance with the embodiment of the present invention, showing the socket body in a hidden state.
Figure 5:
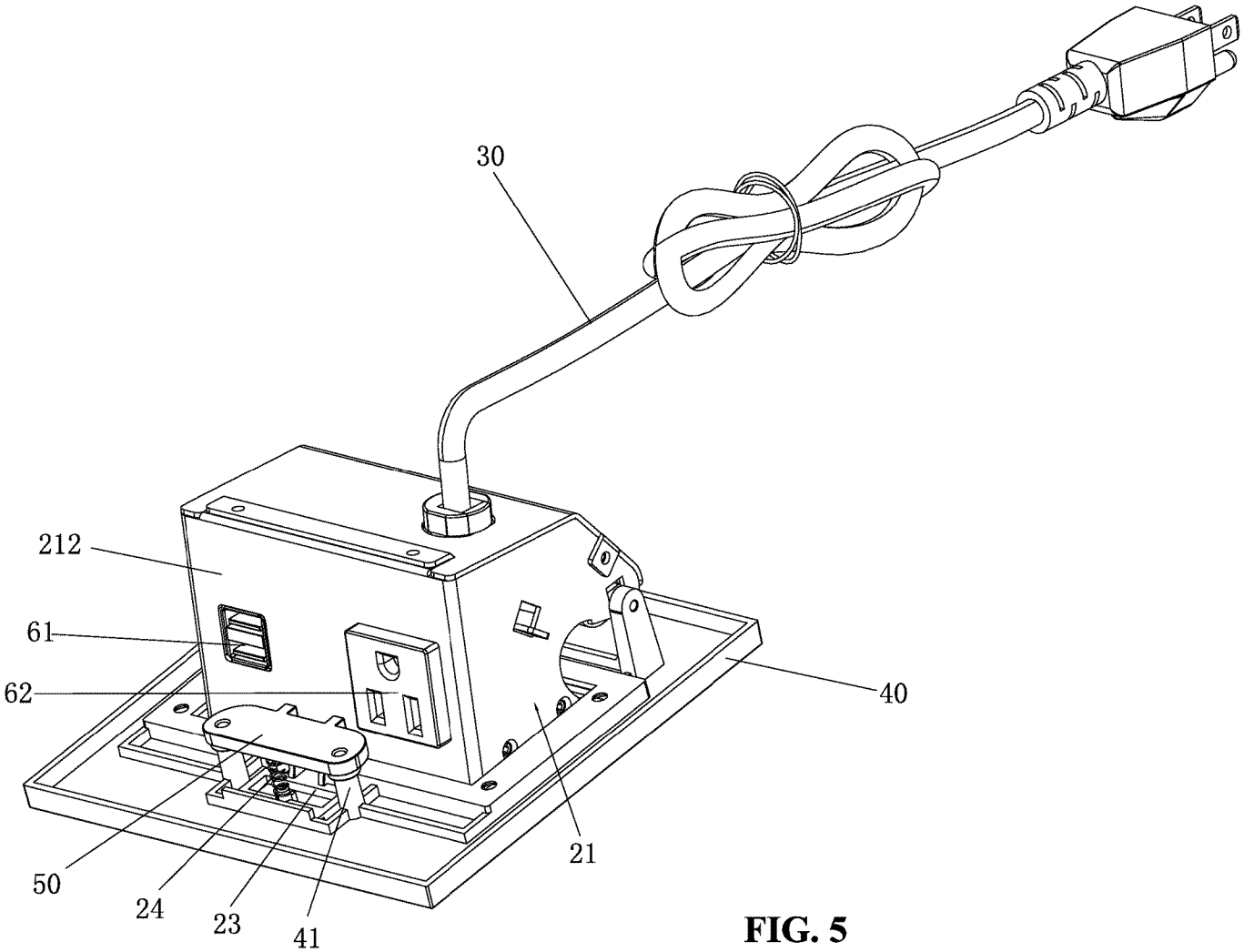
FIG. 5 is another schematic view of FIG. 4.
Figure 6:
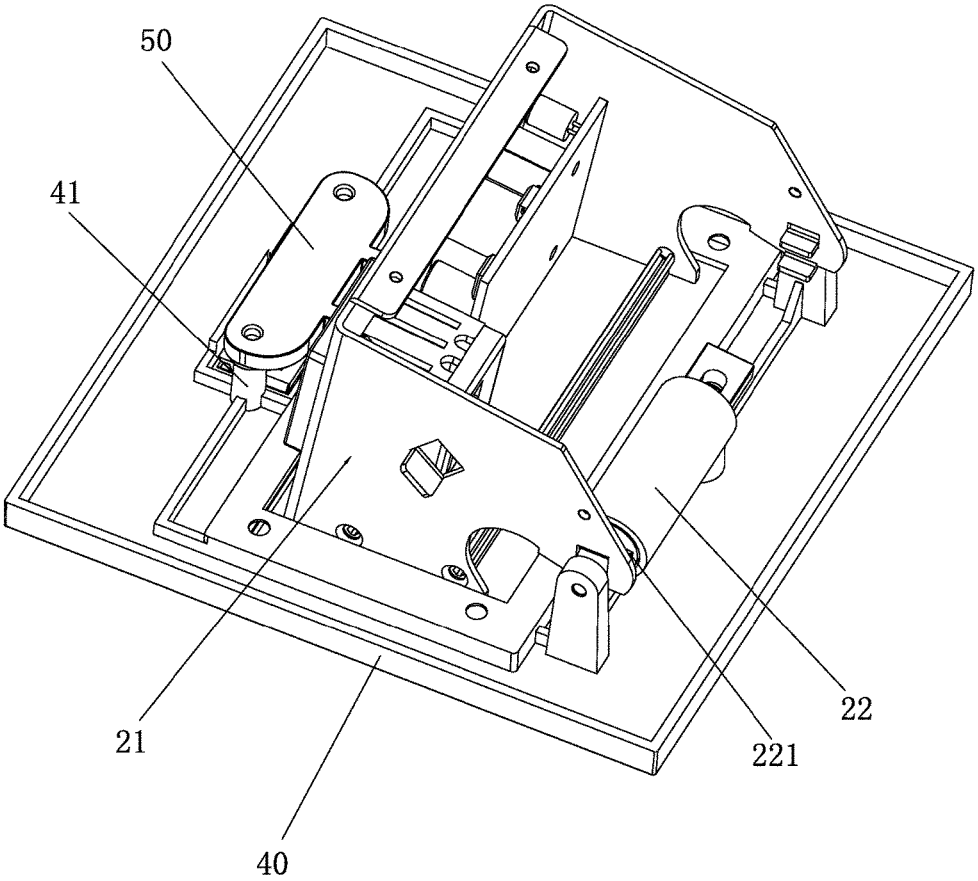
FIG. 6 is another schematic view of FIG. 4 (without the power cord)
Figure 7:
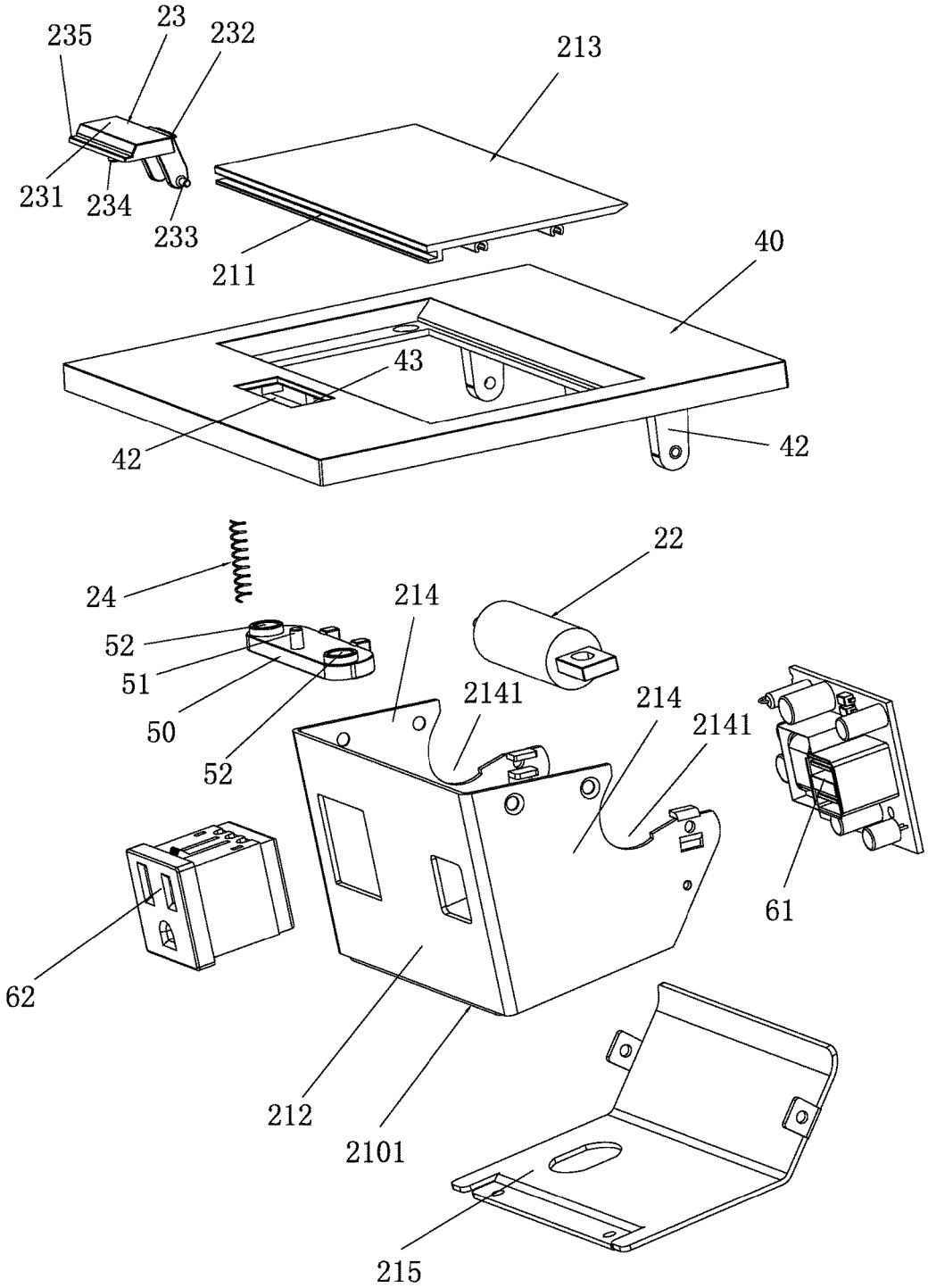
FIG. 7 is an exploded view of FIG. 4 (without the power cord)
Figure 8:
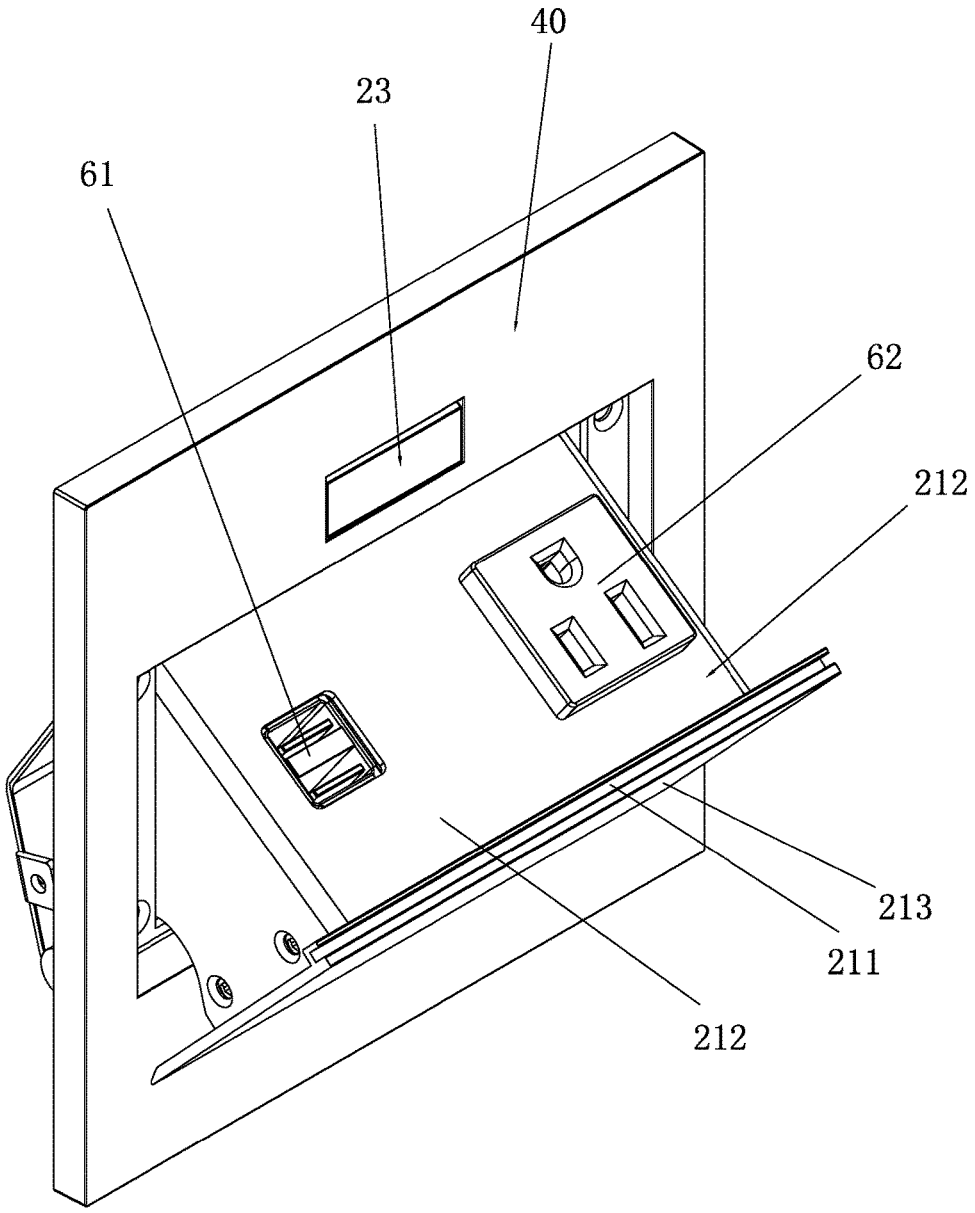
FIG. 8 is a schematic view of FIG. 4 (without the power cord), showing the socket body in a pop-up state.

As shown in FIG. 1 to FIG. 8, the present invention discloses a table cabinet having a reversible power socket. The table cabinet in accordance with an embodiment of the present invention comprises a table cabinet main body 10. The table cabinet main body 10 has a mounting opening 11. A reversible power socket 20 is mounted to the mounting opening 11.

Wherein, the table cabinet main body 10 is a wooden table cabinet main body, a plastic table cabinet main body, or a metal table cabinet main body. In this embodiment, the front of the table cabinet main body 10 is provided with a door 101 that can be opened and closed. A drawer 102 is provided above the door 101. The other three sides of the table cabinet main body 10 are hermetically disposed. The bottom of the table cabinet main body 10 is provided with a flat support base or at least two spaced support legs. The power socket 20 is connected with a power cord 30. The power cord 30 is led out from a perforation 12 provided in the table cabinet main body 10.

The power socket 20 includes a socket body 21, a power supply interface provided on the socket body 21, a pop-up device 22 for providing an outwardly pivoting force to the socket body 21, and a pop-up button 23 for limiting and controlling the socket body 21. The pop-up device 22 has a rotating shaft 221. The rotating shaft 221 is connected to the socket body 21 for controlling the socket body 21 to be rotatably disposed relative to the table cabinet main body 10. The pop-up button 23 has a press portion 231 and a first engaging point 232. The pop-up button 23 is connected with a return spring 24 for returning the pop-up button 23. One end of the return spring 24 is connected to the pop-up button 23, and another end of the return spring 24 is fixed to the table cabinet main body 10. The socket body 21 is provided with a second engaging point 211 mated with the first engaging point 232. The first engaging point 232 is a convex, and the second engaging point 211 is a concave.

In this embodiment, the pop-up device 22 includes a torsion spring therein. One end of the torsion spring is interconnected with the rotating shaft. When the power socket 20 is bounced out of the mounting opening 11, the first engaging point 232 of the pop-up button 23 releases the second engaging point 211 of the power socket 20, and the torsion spring of the pop-up device 22 is returned to a normal state, and the power supply interface of the socket body 21 is exposed to the mounting opening 11. When the power socket 20 is buckled and hidden in the mounting opening 11, the first engaging point 232 of the pop-up button 23 is engaged with the second engaging point 211 of the socket body 21, and the torsion spring of the pop-up device 22 is in a compressed state, and the power supply interface of the socket body 21 is hidden in the mounting opening 11. When the power socket 20 is required, the pop-up device 22 is actuated by pressing the pop-up button 23 to drive the socket body 21 to be popped out. The socket body 21 can be directly pressed inwardly when not in use. The operation is convenient and practical. The power socket 20 is protected. The present invention not only enhances the safety of the use for the power socket 20 but also improves the cleanliness of the table cabinet surface, in particular, its simple structure, easy to control, good reliability.

The tablet cabinet main body 10 is provided with a mounting seat 40. The mounting seat 40 is provided with the mounting opening 11. The mounting seat 40 may be made of a metal material, a plastic material, etc., but not limited thereto. The socket body 21 is pivotally connected to the mounting seat 40. The pop-up device 22 is disposed on the mounting seat 40. An inner side of the mounting seat 40 is connected with a press block 50. The return spring 24 is connected between the pop-up button 23 and the press block 50. The mounting seat 40 is provided with a button accommodation opening 42 located beside the mounting opening 11. The button accommodation opening 42 and the mounting opening 11 are in communication with a through groove 43. The first engaging point 232 extends from the through groove 43 to the mounting opening 11. The pop-up button 23 is mounted in the button accommodation opening 42. The pop-up button 23 is provided with a fulcrum 233 between the press portion 231 and the first engaging point 232. The return spring 24 is connected to the press portion 231. The first engaging point 232 is tilted outward when the press portion 231 is pressed and displaced inward. The pop-up button 23 has a limit side 235 for preventing the pop-up button 23 from disengaging outwards. When the pop-up button 23 is mounted, it is mounted from the inner side of the mounting seat 40, and the press portion 231 of the pop-up button 23 is exposed to the button accommodation opening 42. Two inner sides of the button accommodation opening 42 are formed with positioning grooves for positioning the fulcrum 233. The fulcrum 233 is disposed at both sides of the pop-up button 23. The fulcrum 233 is located at the corresponding positioning grooves.

The pop-up button 23 is formed with a first positioning post 234. The press block 50 is formed with a second positioning post 51 corresponding to the first positioning post 234. The two ends of the return spring 24 are fitted to the first positioning post 234 and the second positioning post 51, respectively. The mounting seat 40 is provided with a pair of connecting posts 41 at two sides of the button accommodation opening 42 toward the press block 50. Each connecting post 41 is formed with a first connecting hole 411. The press block 50 is formed with a second connecting hole 52 corresponding to the first connecting hole 411. A screw is connected to the first connecting hole 411 and the second connecting hole 52.

The power supply interface includes any one or both of a USB charging interface 61 and a mains electricity supply interface 62. The number of the interfaces is not limited and can be arranged on demand. In the actual design, the size of the socket body 21 and the arrangement of the interfaces can be designed according to the specific requirements. Generally, the USB charging interface 61 can be used to charge a mobile device, such as a mobile phone or iPad, and the mains electricity supply interface 62 can provide a standard utility power, which is convenient and practical.

The socket body 21 has a first panel portion 212 for mounting the power supply interface and a second panel portion 213 for covering the mounting opening 11. The first panel portion 212 and the second panel portion 213 are perpendicular to each other. The socket body 21 includes a cover body 2101. The cover body 2101 has the first panel portion 212 and two side plate portion 214 connected to both sides of the first panel portion 212. The front and rear sides of the cover body 2101 have openings, respectively. The opening of the front side of the cover body 2101 is provided with a cover plate 215. The opening of the rear side of the cover body 2101 is provided with the second panel portion 213. The two side plate portions 214 of the socket body 21 are pivotally connected to the mounting seat 40. The mounting seat 40 is provided with two lateral support plates 42 extending inward. The inner ends of the lateral support plates 42 are formed with pivot holes, so that the two side plate portions 214 are pivotally connected to the corresponding lateral support plates 42, respectively. The two side plate portions 214 are formed with notches 2141 to facilitate rotation.

In general, the power socket is preferably disposed on the back or top surface of the table cabinet main body 10 for ease of operation. Specifically, in an embodiment, the mounting opening 11 is disposed on the back of the table cabinet main body 10. When the socket body 21 is hidden inside the mounting opening 11, the first panel portion 212 is horizontally disposed at the top of the socket body 21, and the second panel portion 213 is vertically disposed at the rear side of the socket body 21. The bottom end of the socket body 21 is pivotally connected to the inner side of the mounting seat 40. In another embodiment, the mounting opening 11 is disposed on the top surface of the table cabinet main body 10. When the socket body 21 is hidden inside the mounting opening 11, the first panel portion is vertically disposed at the front side or the rear side of the socket body 21, and the second panel portion is horizontally disposed at the top of the socket body 21. A side of the socket body 21, opposite to the first panel portion, is pivotally connected to the inner side of the mounting seat 40.

Although particular embodiments of the present invention have been described in detail for purposes of illustration, various modifications and enhancements may be made without departing from the spirit and scope of the present invention. Accordingly, the present invention is not to be limited except as by the appended claims.

What is claimed is:

1. A table cabinet having a reversible power socket, comprising a table cabinet main body, the table cabinet main body having a mounting opening, the reversible power socket being mounted to the mounting opening; the power socket including a socket body, a power supply interface on the socket body, a pop-up device for providing an outwardly pivoting force to the socket body, and a pop-up button for limiting and controlling the socket body; the pop-up device having a rotating shaft, the rotating shaft being connected to the socket body for controlling the socket body to be rotatably disposed relative to the table cabinet main body; the pop-up button having a press portion and a first engaging point, the pop-up button being connected with a return spring for returning the pop-up button, one end of the return spring being connected to the pop-up button, another end of the return spring being fixed to the table cabinet main body; the socket body being provided with a second engaging point mated with the first engaging point, wherein the tablet cabinet main body is provided with a mounting seat, the mounting seat is provided with the mounting opening; the socket body is pivotally connected to the mounting seat, the pop-up device is disposed on the mounting seat; an inner side of the mounting seat is connected with a press block, the return spring is connected between the pop-up button and the press block; the mounting seat is provided with a button accommodation opening located beside the mounting opening, the button accommodation opening and the mounting opening are in communication with a through groove; the pop-up button is mounted in the button accommodation opening, the pop-up button is provided with a fulcrum between the press portion and the first engaging point, the return spring is connected to the press portion; and the first engaging point is tilted outward when the press portion is pressed and displaced inward.

2. The table cabinet as claimed in claim 1, wherein the pop-up device includes a torsion spring therein, one end of the torsion spring is interconnected with the rotating shaft; when the power socket is bounced out of the mounting opening, the first engaging point of the pop-up button releases the second engaging point of the power socket, the torsion spring of the pop-up device is returned to a normal state, and the power supply interface of the socket body is exposed to the mounting opening; when the power socket is buckled and hidden in the mounting opening, the first engaging point of the pop-up button is engaged with the second engaging point of the socket body, the torsion spring of the pop-up device is in a compressed state, and the power supply interface of the socket body is hidden in the mounting opening.

3. The table cabinet as claimed in claim 1, wherein the pop-up button is formed with a first positioning post, the press block is formed with a second positioning post corresponding to the first positioning post, the two ends of the return spring are fitted to the first positioning post and the second positioning post respectively; the mounting seat is provided with a pair of connecting posts at two sides of the button accommodation opening toward the press block, each of the connecting posts is formed with a first connecting hole, the press block is formed with a second connecting hole corresponding to the first connecting hole, and a screw is connected to the first connecting hole and the second connecting hole.

4. The table cabinet as claimed in claim 1, wherein the power supply interface includes any one or both of a USB charging interface and a mains electricity supply interface.

5. The table cabinet as claimed in claim 1, wherein the socket body has a first panel portion for mounting the power supply interface and a second panel portion for covering the mounting opening, and the first panel portion is perpendicular to the second panel portion.

6. The table cabinet as claimed in claim 5, wherein the mounting opening is disposed on a back of the table cabinet main body; when the socket body is hidden inside the mounting opening, the first panel portion is horizontally disposed at a top of the socket body, the second panel portion is vertically disposed at a rear side of the socket body; and a bottom end of the socket body is pivotally connected to the inner side of the mounting seat.

7. The table cabinet as claimed in claim 5, wherein the mounting opening is disposed on a top surface of the table cabinet main body; when the socket body is hidden inside the mounting opening, the first panel portion is vertically disposed at a front side or a rear side of the socket body, the second panel portion is horizontally disposed at a top of the socket body; and a side of the socket body, opposite to the first panel portion, is pivotally connected to the inner side of the mounting seat.

8. The table cabinet as claimed in claim 1, wherein the power socket is connected with a power cord, and the power cord is led out from a perforation of the table cabinet main body.

9. The table cabinet as claimed in claim 1, wherein the table cabinet main body is one of a wooden table cabinet main body, a plastic table cabinet main body and a metal table cabinet main body; a front of the table cabinet main body is provided with a door that can be opened and closed, other three sides of the table cabinet main body are hermetically disposed; and a bottom of the table cabinet main body is provided with a flat support base or at least two spaced support legs.

* * * * *